United States Patent [19]

Ueno et al.

[11] 4,033,565

[45] July 5, 1977

[54] MUD GUN HAVING CLAMPING DEVICE

[75] Inventors: Masayuki Ueno; Fumiaki Sano, both of Yokohama, Japan

[73] Assignee: Ishikawajima-Harima Jukogyo Kabushiki Kaisha, Ote, Japan

[22] Filed: Jan. 3, 1977

[21] Appl. No.: 754,672

[30] Foreign Application Priority Data

Aug. 10, 1976 Japan ..... 51-95238

[52] U.S. Cl. ..... 266/273

[51] Int. Cl.[2] ..... C21B 7/12

[58] Field of Search ..... 266/271–273

[56] References Cited

FOREIGN PATENTS OR APPLICATIONS 417,476 7/1974 U.S.S.R. ..... 266/273

*Primary Examiner*—Gerald A. Dost

*Attorney, Agent, or Firm*—Scrivener, Parker, Scrivener & Clarke

[57] ABSTRACT

Disclosed is a clamping device for securely locking a turret of a mud gun in operative position where a gun barrel, which has been traversed and elevated to a blowing position, has its nozzle firmly pressed against a tap hole of a shell of a furnace to blow a mud projectile into the tap hole.

4 Claims, 12 Drawing Figures

MUD GUN HAVING CLAMPING DEVICE

DETAILED DESCRIPTION OF THE INVENTION

The present invention relates to generally a mud gun for closing a tap hole of a blast furnace and more particularly a clamping device therefor.

In general, mud guns have been widely used for closing tap holes of hot-blast furnace. In operation, a cradle or turret on which is mounted a mud gun barrel is traversed from a retracted position to and must be securely clamped in an operative position in order to avoid the change in firing position. With an automatic, romote-controlled mud gun, a cradle or turret must be automatically traversed to an operative position and then securely clamped in position, and after a tap hole has been completely filed, the cradle or turret must be automatically released and reversed to the retracted position. Therefore the automatic mud gun must incorporate a device for detecting whether the cradle or turret has been securely clamped or released, and this detection device must be highly reliable and dependable in operation.

The mud guns with the prior art clamping devices are for instance disclosed in Japanese Patent Publications numbered 852 and published in 1955, numbered 14,415 and published in 1956 as Utility Model, numbered 907 and published as Utility Model in 1958. All of these clamping devices are disclosed as being mounted on the shell of a furnace above a tap hole so that they have some problems to be described below:

1. In general, they are of the type wherein a hook (also called "a hacker") is swung upwardly or downwardly through a linkage consisting of links and levers so as to be brought into engagement with a latch anchored to the shell or to be released therefrom. Therefore they are very complex in construction with a relatively large number of moving parts so that malfunctions tend to occur very frequently and great care must be excercised in assembly and adjustment.

2. Since the clamp devices are disposed immediately above the tap holes, molten iron and slags are splashed and adhered to them so that their operations are adversely affected and concurrently they are exposed to considerably high temperatures with the resultant damages to the clamping devices and control devices such as limit switches.

3. With increase in capacity of blast furnaces and in operating pressure, the above problems are further amplified so that the mud guns become less reliable and dependable in operation and consequently so do the furnace operations.

In order to overcome the above and other problems encountered in the prior art clamping devices, the same inventor(s) disclosed in Japanese Patent Publication No. 1,683 published in 1971 a clamping device for clamping a turret of a mud gun with a hook which is selectively made into engagement with a latch anchored to a foundation backwardly of the mud gun and sufficiently spaced apart from the shell of a furnace. In this device, however, the hook is so disposed as to swing in a horizontal plane so that it cannot engage with the latch by its own weight. As a result, the clamping device was not reliable in operation and malfunctions occured very frequently. Furthermore, the above Patent Publication does no disclose specifically and distinctly the mechanism of the clamping device, especially a control system for bringing a traversing turret into rest and a device for automatically detecting whether the hook has been made into engagement with the latch or it has been released therefrom.

More specifically, in the prior art mud guns, a device for stopping the traverse of a turret or cradle and a device for controlling the former and a clamping device are disposed completely independently of each other in operation. For instance, in the mud guns disclosed in the above patent publications, a turret is powered with an electric motor for traversing, is controlled to stop with a limit switch and an electro-magnetic brake and then is clamped in operative position relative to the shell of a furnace. That is, the turret is controlled in two steps. In a hydraulically-operated mud gun of the type disclosed in Japanese Patent Publication No. 1,683 published in 1971, a turret is traversed by a hydraulic motor and a limit switch is used for detecting whether or not the turret has passed a predetermined position. In response to an output from the limit switch a hydraulic circuit is so actuated as to change the hydraulic pressure of working oil, thereby decelerating the traversing of the turret and then stopping the turret. Thereafter, a hook or the like is made into engagement with a latch anchored to a foundation. That is, the turret is controlled in two steps.

As described above, in the prior art mud guns immediately after a turret has been gradually decelerated and stopped, it is clamped in position. As a result, adjustment of control timing is exceedingly difficult so that abrupt interruption of the traversing of the turret and clamping occur very often with the resultant impacts on the turret and clamping device. As a result, they tend to be damaged very easily and furthermore the mud gun operation is adversely affected. Moreover a control device is complex in construction, is easily susceptible to damage and is expensive in cost and not reliable in operation.

In the clamping device of the type disclosed in Utility Model Publication No. 907 published in 1958, springs are utilized in order to damp or absorb impacts exerted when a turret is clamped, but the fundamental object of the provision of these springs to automatically cause the hook to engage with or released from the latch through a linkage consisting of levers and/or links. In other words, it is nothing but an auxiliary function for the springs to damp the shock produced when the turret is made to gradually strike a stopper on a receiving member anchored to the shell of the furnace after the turret has been decelerated and stopped in the manner described above. Therefore the springs can not effectively stop the traversing of the turret.

The present invention was made to overcome the above and other problems encountered in the prior art clamping devices for mud guns, and will become apparent from the detailed description of a preferred embodiment thereof taken conjunction with the accompanying drawings, in which:-

Figure 8:
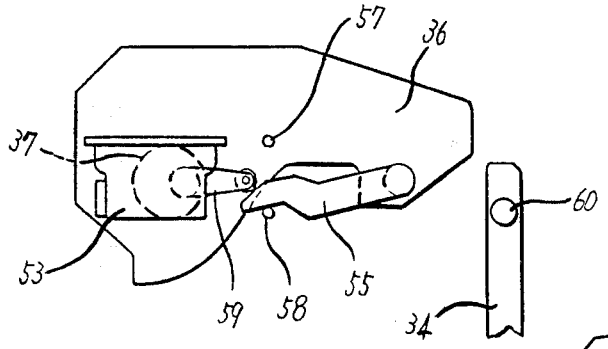
Figure 9:
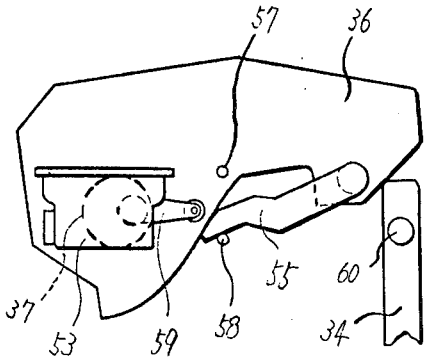
Figure 10:
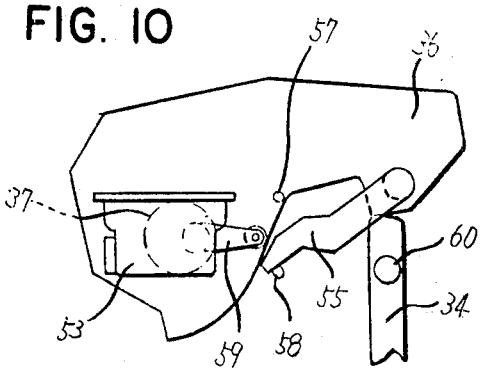
Figure 11:
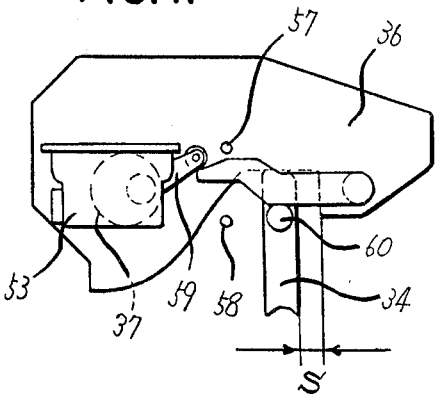
Figure 12:
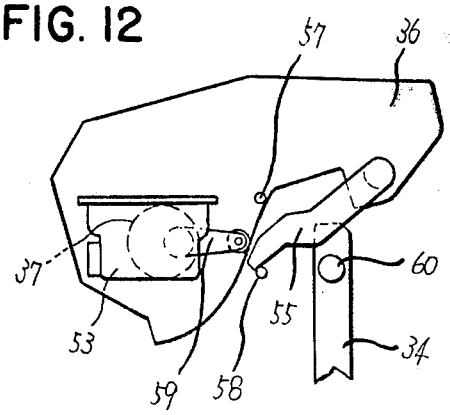

FIGS. 8 through 12 are views used for the explanation of the mode of operation of the clamping device; FIG. 8 showing a hook moving toward a latch; FIG. 9 showing the hook whose tapered end rides over the latch whereby the hook is rotated in the counterclockwise directions; FIG. 10 showing the hook at the upper dead center; FIG. 11 showing the hook in partial engagement with the latch prior to the complete engagement; and FIG. 12 showing the hook which is released from the latch.

Figure 1:
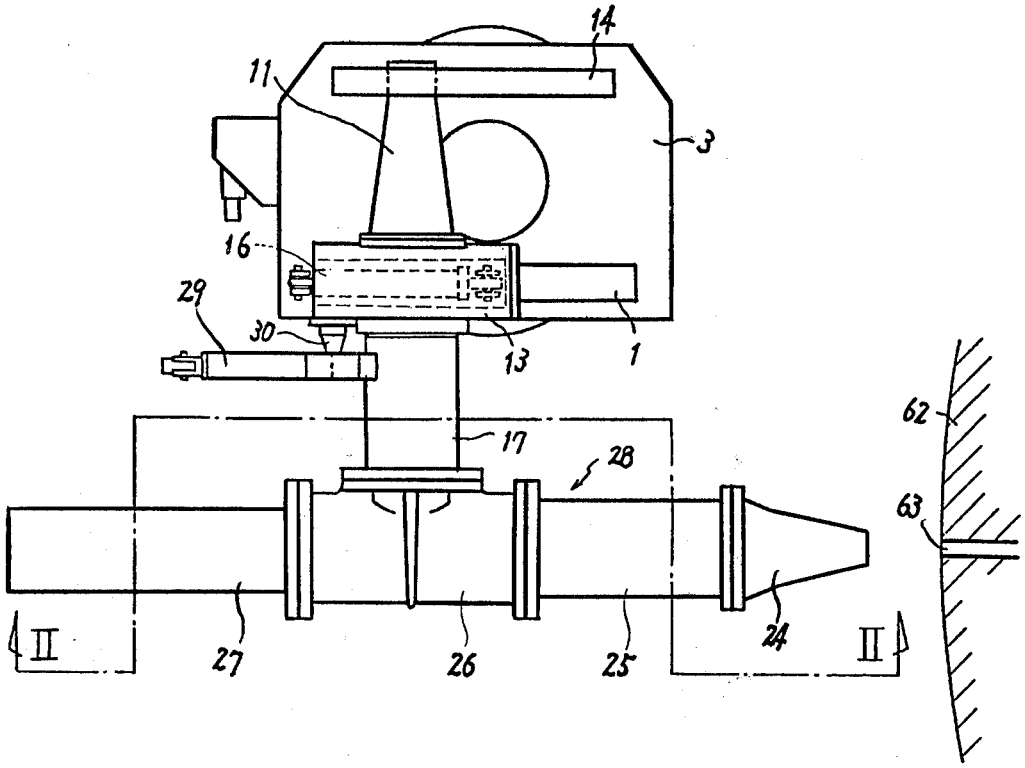
FIG. 1 is a top view of a mud gun having a clamping device in accordance with the present invention.
Figure 2:
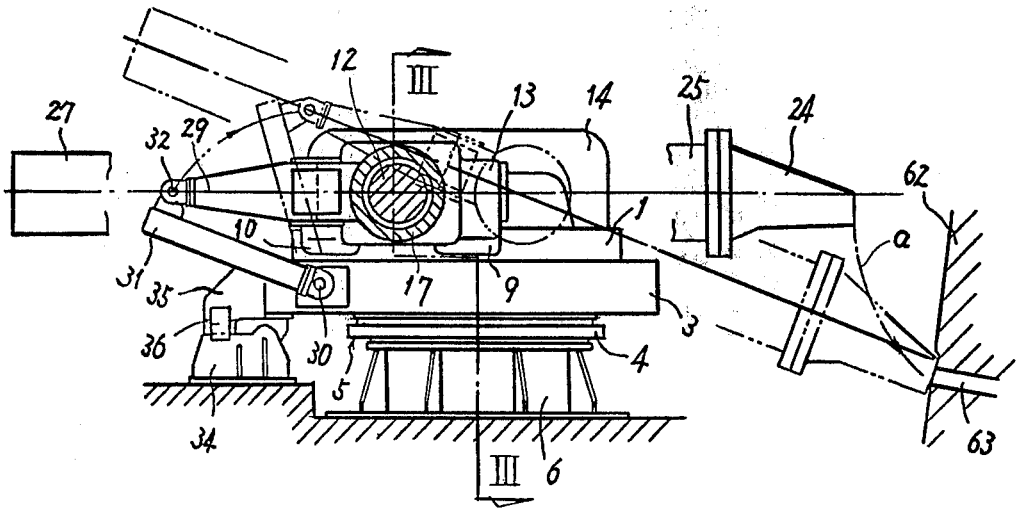
FIG. 2 is a side view, partly in section, thereof looking in the direction indicated by the arrows II—II of FIG. 1.
Figure 3:
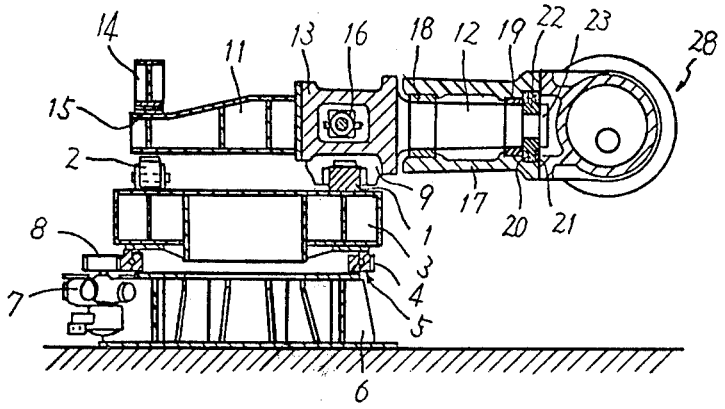
FIG. 3 is a sectional view taken along the line III—III of FIG. 2.

Referring to FIGS. 1, 2 and 3, a mud gun in accordance with the present invention may be moved in three directions. That is, a gun barrel generally indicated by 28 may be traversed about the axis of rotation of a box-shaped turret 3, moved toward or away from a furnace shell 62 and, simultaneous with the forward movement of the turret 3, elevated or inclined downwardly as indicated by the broken lines in FIG. 2 about the axis of an elevation barrel 17 toward a tap hole 63 of the furnace shell 62.

The box-shaped turret 3 is of a frame structure and has an externally threaded traversing wheel 5 rotatably mounted on a pedestal 6 which in turn is securely anchored to a foundation. Gear teeth 4 of the traversing wheel 5 is in mesh with a driving pinion of an actuator (See FIG. 3) so that upon actuation of the actuator 7 the turret 3 and hence the mud gun may be traversed in either direction through about 180° through the axis of the traversing wheel 5.

Main and auxiliary guide rails 1 and 2 of a square cross section are mounted in parallel with each other on the deck of the turret 3, and an auxiliary guide frame 14 is mounted immediately above the auxiliary guide rail 2, spaced apart therefrom by a suitable distance and extended in the same direction as the auxiliary guide rail 2. A hollow cradle 13 from which are extended a cradle arm 11 and an elevation shaft 12, has axially-spaced inverted-U-shaped guide grooves 9 and 10 which are slidably fitted over the main guide rail 1. The cradle arm 11 is extended from the cradle 13 at a right angle to the axis thereof and has a free end terminated into an auxiliary guide 15 which is guided between the auxiliary guide rail 2 and frame 14 (See FIG. 3). A first hydraulic cylinder 16 is disposed within the cradle 13 and has its cylinder head pivoted to the turret 3 and a free end of a piston rod pivoted to the cradle 13 so that upon actuation of the first hydraulic cylinder 16 the cradle 13 is caused to move toward or away from the furnace shell 62 along the main guide rail 1. The axis of the first hydraulic cylinder 16 is located in a horizontal plane including the axis of the elevation shaft 12.

The elevation shaft 12 is frustoconical, converging gradually toward its free end and is extended at a right angle from the cradle 13 in the direction opposite to the cradle arm 11. The cylindrical elevation barrel 17 which has a hole substantially similar in shape to the elevation shaft 12 is coaxially fitted thereon for rotation with axially spaced antifriction bearings 18 and 19. An outer end (that is, the end remote from the cradle 13) of the elevation barrel 17 is terminated into a mounting flange upon which is mounted the gun barrel 28. A thrust collar 22 with thrust bearings 20 and 21 mounted over the outer periphery thereof is bolted, together with an end plate 23, to the free end of the elevation shaft 12 to take thrust loads acting in the horizontal direction on the elevation barrel 17.

The gun barrel 28 consists of, as best shown in FIG. 1, a nozzle 24, which may be aimed at the tap hole 63 as shown in FIG. 2, a front barrel section 25, a rear barrel section 26 and a second hydraulic cylinder 27 including a mud-blowing plunger (not shown), all of which are bolted together into a unitary construction. The gun barrel 28 is mounted on the outer end of the elevation barrel 17 perpendicular to the axis thereof.

The elevation barrel 17 has an arm which is backwardly extended in parallel with the main guide 1 and has its free end pivoted with a pin 32 to one end of a link 31 having the other end pivoted with a pin 30 to the cradle 13 on the same side with the elevation barrel 17 so that an arm-link assembly may not only encounter a turning force exerted from the gun barrel 28 to the elevation barrel 17 when the first hydraulic cylinder 16 is locked but also rotate the elevation barrel 17 simultaneous with the horizontal movement of the cradle 13, whereby the gun barrel 28 may be elevated.

Figure 4:
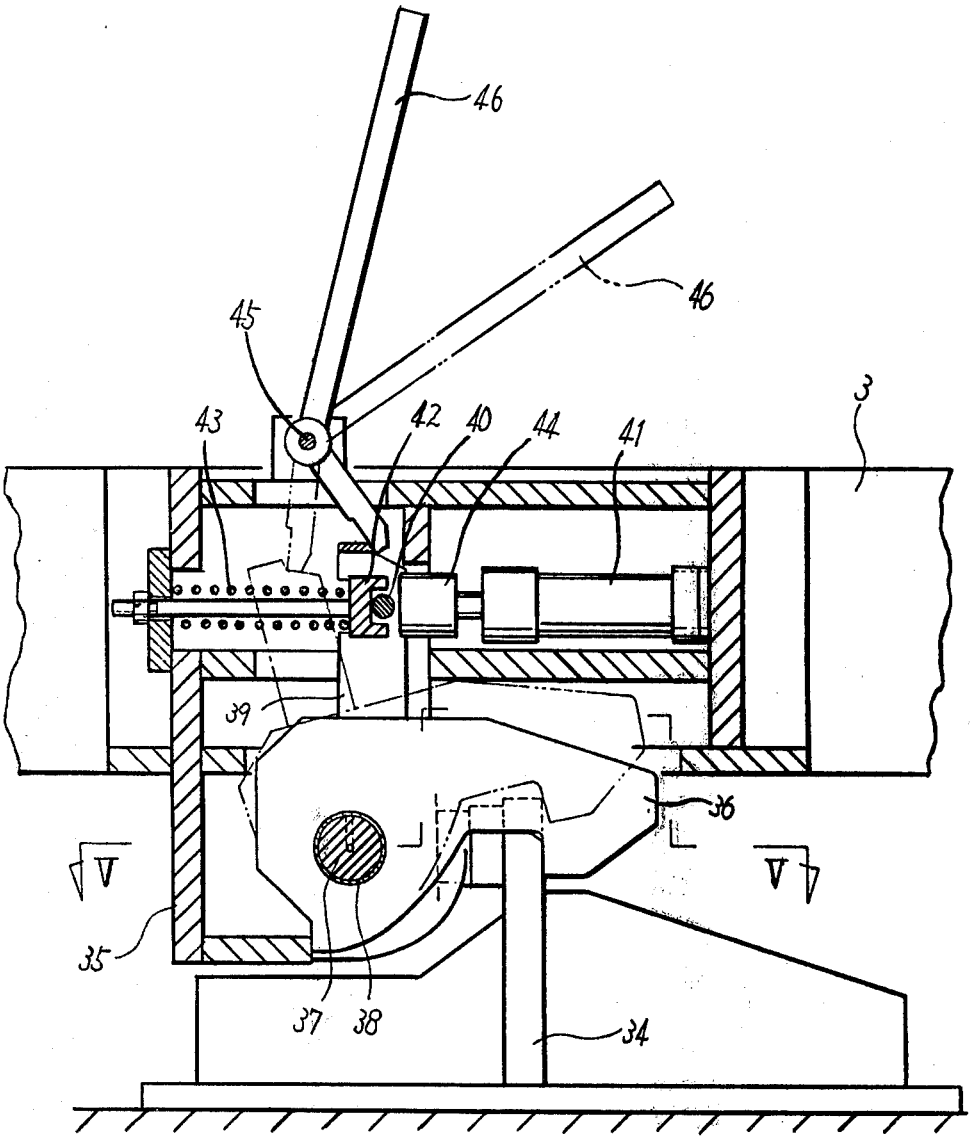
FIG. 4 is a view, on enlarged scale and partly in section, of a clamping device.
Figure 5:
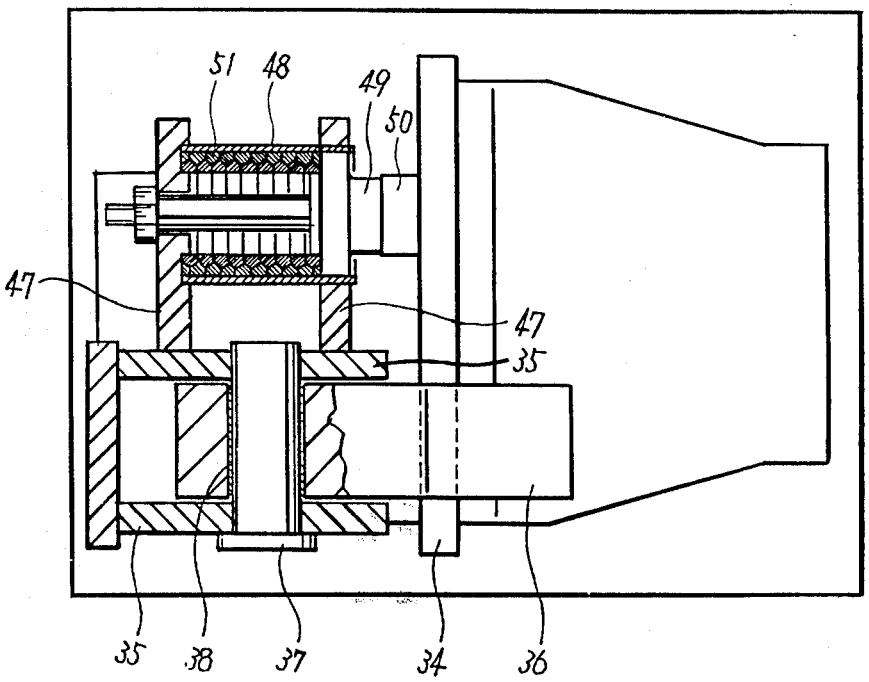
FIG. 5 is a sectional view taken along the line V—V of FIG. 4.

Referring further to FIGS. 4 through 7, a latch 34 is securely anchored to the foundation backwardly of the pedestal 6 (See FIG. 2) for releasable engagement with a hook 36 of a hook mount 35 mounted on the rear side of the turret 3. As shown in FIGS. 4 and 5, the hook 36 is fitted with a bushing 38 over a pin 37 extended from a lower portion of the hook mount 35 so that the hook 36 may be rotated about the pin 37 in a vertical plane perpendicular to the axis thereof. The hook 36 has an engaging recess for engagement with the latch 34 and upwardly extended projections 39 which are spaced apart in the axial direction of the pin 37 and support a pin 40 extended in parallel with the pin 37.

A third hydraulic cylinder 41 is mounted on the hook mount 35 in such a way that a free end 44 of a piston rod may be located adjacent to the pin 40 except when the hook 36 is rotated about the pin 37 in the counterclockwise direction or upwardly. A shaft of a fork member 42 is slidably fitted into a hole formed through a side wall in opposed relation with the hydraulic cylinder 41 so that a bifurcated portion of the form member 42 may be displaced a relatively short distance relative to the pin 40. A coiled spring 43 is fitted over the shaft of the fork member 42 between the side wall and the bifurcated portion so that the hook 36 may be normally biased to rotate in the clockwise direction in FIG. 4 under the force of the coiled spring 43 and by its own weight of the hook 36.

An operating lever 46 is pivoted with a pin 45 to the top of the hook mount 35 and has its lower end terminated into a hook in engagement with the top end of the projection 39. When an operator pulls or pushes the operating lever 46 to rotate it about the pin 45 in the clockwise direction in FIG. 4 as indicated by the broken lines, the hook 36 is caused to swing in the counter-clockwise direction away from the latch 34.

Referring particularly to FIG. 5, the hook mount 35 has a bracket 47 extended outwardly in parallel with the axis of the pin 37 for supporting a cylinder 48 with its axis in parallel with the hook 36. A piston-shaped stopper 49 is slidably fitted into the cylinder 48 and extended out of the cylinder to about against a receiving member 50 extended from the latch 34. Ring springs 51 are loaded in the cylinder 48 and are compressed by the stopper 49, yielding a compressive force of about 30,000 kg in order to encounter the whole inertia of traversing members such as the turret 3.

The hook mount 35 has another bracket 52 extended from the side wall thereof opposite to the bracket 47, and a limit switch 53 is mounted on the bracket 52 (See FIGS, 6 and 7).

A striker 55 having a straight portion and a bent portion has its one end pivoted to a pin 54 extended from the hook 36 outwardly in parallel with the pin 37. A torsion spring 56 is fitted over the pin 54 with one end attached thereto and the other end attached to the striker 55 so that the latter is normally biased in the counterclockwise direction in FIG. 6. Two vertically spaced stoppers 57 and 58 are extended outwardly from the hook mount 35 in parallel with the pin 37 above and below the striker 55, so that the swinging of the striker 55 is limited by them. The striker 55 is made into soft contact with a roller at the free end of a roller-lever 59 of the limit switch 53 when the hook 36 is brought into a horizontal position, and is held in a horizontal position by a stopper or pushing rod 60 extended from the latch 34 when the hook 36 is made into engagement therewith. A dust-proof, heat-resisting cover 61 is provided to enclose therein the clamping and detection devices including the hook mount 35, the limit switch 53 and so on.

Next referring further to FIGS. 8 through 12, the mode of operation will be described. To close the tap hole 63 in the furnace shell 62, the actuator 7 is energized to drive the traversing wheel 5 thereby traversing the gun barrel 28 from a retracted position. In this case, the hook 36 is held in a retracted position as shown in FIG. 8, and the striker 55 is made into contact with the lower stopper 58 by its own weight and under the biasing force of the torsion spring 56. The roller lever 59 is held in a neutral position.

As the turret 3 is traversed so that the tapered end of the hook 36 is made into contact with the latch 34 as shown in FIG. 9, the hook 36 is caused to rotate about the pin 37 in the counterclockwise direction as shown in FIG. 10. In this case, the lower side adjacent to the free end of the striker 55 is kept in contact with the lower stopper 58 and the roller lever 59 still remains in the neutral position.

Upon rotation of the hook 36 in the counterclockwise direction, its projections 39 (See FIG. 4) are also rotated in the same direction so that the pin 40 causes the fork member 42 to displace itself to the left in FIG. 4, compressing the spring 43. As the traverse of the turret 3 continues, a short straight portion continuous with the tapered portion of the hook 36 rides over the latch 34 as shown in FIG. 10, and when the straight portion passes beyond the latch 34, the groove or recess of the hook 36 is suddenly made into contact with the latch 34 as shown in FIG. 11. As a result, the hook 36 is caused to rotate in the clockwise direction about the pin 37 by its own weight and under the force of the coiled spring 43, whereby the hook 36 is made into engagement with the latch 34 as shown in FIG. 11. Then the stopper or pushing rod 60 is made into contact with the striker 55 at a point intermediate at its end so that the striker 55 is caused to rotate about the pin 54 in the clockwise direction and consequently the free end of the striker 55 pushes upward the roller at the free end of the roller lever 59 of the limit switch 53. As a consequence, a clamped signal; that is, an electrical signal representative of the hook being clamped is transmitted from the limit switch 53 to the actuator 7, and in response to this clamped signal, the actuator 7 is de-energized, whereby the traverse of the gun barrel 28 may be automatically stopped. When the striker 55 strikes the stopper or pushing rod 60 and is held in the position shown in FIG. 11, the torsion spring 56 receives the impact exerted to the striker 55 so that the latter may be made into soft contact with the roller lever 59 of the limit switch 53. The coiled spring 43 serves to dampen abrupt bouncing of the hook 36 and the impact exerted thereto when the hook 36 is made into sudden engagement with the latch 34 as shown in FIG. 11 from the position shown in FIG. 10.

Meanwhile the front end or head of the stopper 49 strikes the receiving member 50 of the latch 34 when the hook 36 is brought from the position shown in FIG. 10 into engagement with the latch 34 as shown in FIG. 11 so that the stopper 49 is pushed back by the receiving member 50 and consequently the ring springs 51 are compressed in the axial direction to absorb and store the whole energy of the traverse of the mud gun. Thus, when the traverse of the turret 3 is finally stopped, a space S is left between the hook 36 and the latch 34 as shown in FIG. 11.

Figure 6:
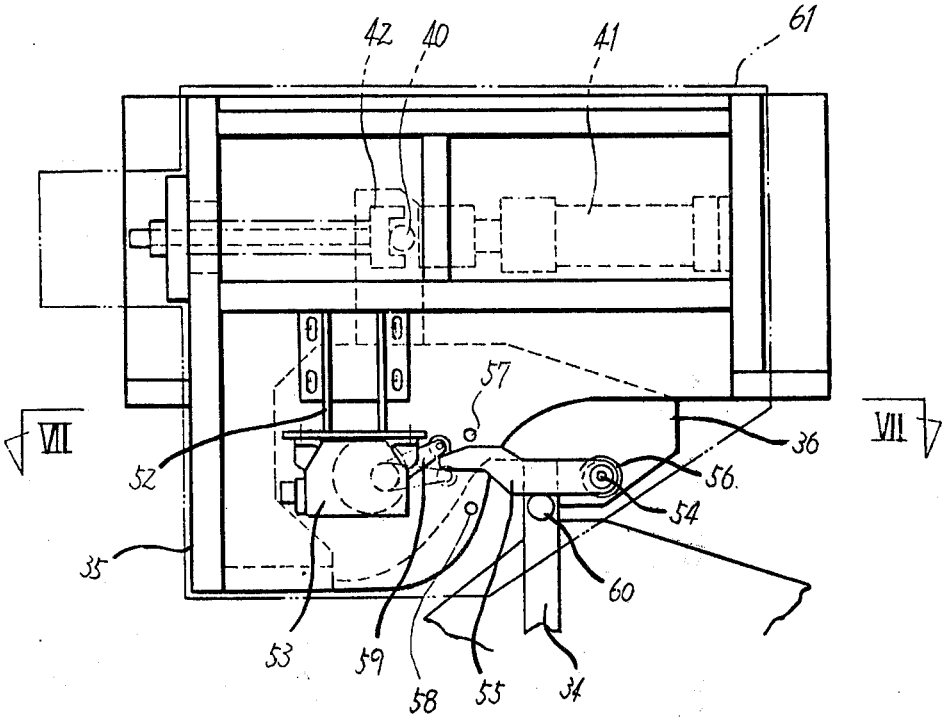
FIG. 6 is a view illustrating a control device for the clamping device shown in FIGS. 4 and 5.
Figure 7:
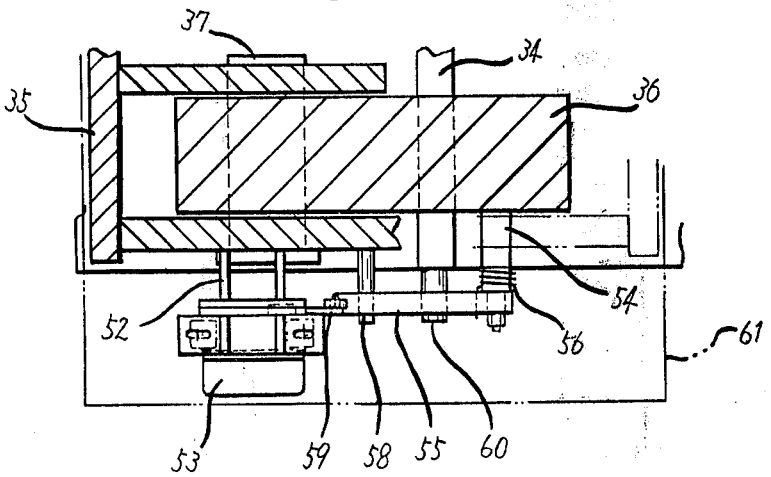
FIG. 7 is a sectional view taken along the line VII—VII of FIG. 6.

The compressed ring springs 51 have now a returning force of about 30,000kg as described above, the turret 3 is instantaneously reversed through an angle corresponding to the space S so that, as shown in FIGS. 4 and 6, the hook 36 is brought to intimate contact with the latch 34. Thus, the turret 3 is completely clamped in position. During the instantaneous reverse of the turret 3, the striker 55 is maintained in the horizontal position as shown in FIG. 11 so that the limit switch 53 remains closed.

After the turret 3 having been completely clamped in position in the manner described above the first hydraulic cylinder 16 is actuated to extend its rod, thereby moving the cradle 13 toward the furnace 62 along the guides 1, 2 and 14 while elevating or inclining downwardly the gun barrel 28 so as to change a mud projectile. More specifically, as the cradle 13 is moved toward the furnace shell 62, the arm-link unit (See FIG. 2) causes the elevation barrel 17 to rotate about the elevation shaft 12 so that the gun barrel 28 is rotated in the clockwise direction and consequently the nozzle 24 describes a locus indicated by one-dot chain lines a in FIG. 2 and is brought into pressed contact with the tap hole 63 as indicated by two-dot chain lines. Then the first hydraulic cylinder 16 is kept to extend its rod; that is, the hydraulic pressure acting on the head side of the piston remains undecreased, and a mud blowing plunger (not shown) is energized to blow the mud projectile into the tap hole 63. The lengths of the arm 29 and link 31 and the positions of the pins 30 and 32 of the arm-link unit are so selected that when the gun barrel 28 is moved toward the furnace shell 62 while rotating in the clockwise direction, the nozzle 24 may be brought to a position where the nozzle end is pressed against the furnace shell 62, completely surrounding the tap hole 63 and the axis of the nozzle hole and the tap hole 63 are accurately aligned with each other.

After the tap hole 63 having been completely filed with mud, the first hydraulic cylinder 16 is actuated again to retract its piston rod, thereby moving the cradle 13 away from the furnace shell 62. Then the operation is reversed. That is, the gun barrel 28 is rotated in the counterclockwise direction in FIG. 2 as it is moved away from the furnace shell 62 to the initial horizontal position indicated by the solid lines in FIG. 2.

Thereafter, the second hydraulic cylinder 41 (See FIG. 4) is actuated to extend its piston rod, pushing the pin 40 to cause the projections 39 of the hook 36 to rotate about the pin 37 in the counterclockwise direction, whereby the hook 36 is released from the latch 34 as shown in FIG. 12. Concurrently the striker 55 is moved upwardly away from the stopper or pushing rod 60 and is rotated in the counterclockwise direction by its own weight and under the force of the torsion spring 56 until the free end of the striker 55 has been brought into engagement with the lower stopper 58. As a result, the roller lever 59 is returned to its neutral position as shown in FIG. 12 so that the limit switch 53 transmits a release signal to the actuator 7. In response to this release signal, the actuator reverses the turret 3 to and holds it in the retracted position. In case of failure of the second hydraulic cylinder 41 or in case of an emmergency, the operator may operates the lever 46 to release the hook 36 from the latch 34.

It is to be understood that the present invention is not limited to the preferred embodiment described above in conjunction with the accompanying drawings and that variations and modifications may be effected without departing the true spirit of the present invention. For instance, instead of pivoting the arm 29 to the turret 3, the arm 29 may have a roller which is fitted into a roller guide on the turret 3. Moreover the axis of the gun barrel 28 or nozzle 24 and the geometrical relationship between the arm 29 and the link 31 may be suitably changed so that a blowing angle of mud relative to the tap hole 63 may be changed as required.

The advantages and features of the mud gun provided with the clamping device in accordance with the present invention may be summarized as follows:

1. Instead of the prior art, special electric or hydrualic decelerating and stopping control devices, the present invention utilizes only mechanical means for stopping the traverse of the turret while providing sufficient damping action and automatically clamp the turret in position. As a conseqence, position control may be remarkably simplified.

2. Moving parts are minimized in number and are made very simple in construction so that the clamping device may be very rigid and compact in size, may be free from failures and consequently the inspection and maintenance may be much facilitated.

3. The clamping device is located backwardly of the mud gun and is suitably spaced apart from the shell of the furnace; all of the moving members such as the hook, limit switch, springs and so on are mounted on the hook mount which is in turn mounted on the rear portion of the turret and they are completely enclosed within the dust-proof, heat-resisting cover. Therefore they are prevented from not only being contaminated with dusts or the like but also being thermally adversely affected in either of the retracted or operative position for closing the tap hole.

4. The limit switch for detecting the engagement of the hook with or release thereof from the latch is physically separated from the hook and latch to which are exerted considerably high impacts, and the limit switch is so arranged as to be actuated by the striker which is made into very soft and smooth contact with the limit switch. As a consequence, the limit switch is free from damage and malfunction.

5. Because of (3) and (4), only the very rigid latch is anchored securely to the foundation so that the tapping operation is not adversely affected at all.

6. Because of (1) through (5), the control of the turret traverse, the clamping and releasing operation and the operation for detecting whether the hook has been clamped or released may be carried out in a highly reliable and dependable manner so that a highly reliable, remote-controlled automatic operation of a mud gun may be feasible. The recent trends of hot-blast furnaces are toward the increase in capacity with the resultant tremendous increase in pressure and the automation for saving labor. As a result, the visual confirmation of the mud gun operations becomes more and more difficult so that an automatic mud gun which is highly accurate, reliable and dependable in operation is demanded. The present invention substantially solve the above problems and may completely meet the above requirements very economically.

What is claimed is:

1. A mud gun having a clamping device comprising a. a latch which has no movable part and is anchored securely to a foundation at a position spaced apart from a shell of a furnace by a suitable distance, b. a hook which is pivoted to a hook mount mounted on a turret of said gun and which is so actuated in response to the traverse of said turret that first a tapered portion of said hook rides on said latch whereby said hook is moved upwardly and then an engaging groove of said hook is brought into engagement with said latch, c. spring means loaded between said hook and said latch for absorbing and storing therein the whole energy for traversing the mud gun in such a way that the mud gun may be gradually brought to rest and then it may be reversed through a predetermined angle, and d. means mounted on said hook mount for causing said hook to rotate away from said latch.

2. A mud gun having a clamping device as defined in claim 1 further comprising a striker which is proved to said hook at a position adjacent to the leading edge thereof and which is caused to rotate upwardly by a pushing rod attached to said latch, and a limit switch mounted on said hook mount and actuable by said striker.

3. A mud gun having a clamping device as defined in claim 1, said mud gun comprising a. a pedestal mounted on said foundation, b. a box-shaped turret of a frame structure rotatable mounted on said pedestal, c. cradle guide means mounted on said turret and consisting of a main guide rail, an auxiliary guide rail laid in parallel with said main guide rail and an auxiliary guide frame disposed immediately above and in parallel with said auxiliary guide rail, d. a cradle slidably mounted on said main guide rail, e. a cradle arm extended outwardly from said cradle at a right angle to the longitudinal axis thereof and having its free end guided by said second guide rail and said auxiliary guide frame, f. an elevation shaft extended from said cradle in the direction opposite to said cradle arm but coaxially thereof, g. an elevation barrel rotatably fitted over said elevation shaft coaxially thereof, h. a gun barrel mounted intermediate at its ends on the outer end of said elevation barrel in such a way that the axis of said gun barrel may be perpendicular to that of said elevation barrel, i. a hydraulic cylinder having its cylinder head mounted on said main guide rail and its piston rod pivoted to said cradle so that upon actuation of said hydraulic cylinder said cradle may be reciprocated along said main guide rail, and j. a linkage interconnecting between said turret and said elevation barrel in such a way that when said cradle is moved toward said shell of said furnace said elevation barrel may be rotated and consequently said gun barrel may be rotated in a vertical plane perpendicular to and including the axis of a tap hole of said furnace and pressed against said tap hole.

4. A mud gun having a clamping device as defined in claim 2, said mud gun comprising a. a pedestal anchored to said foundation, b. a box-shaped turret of a frame structure rotatably mounted on said pedestal, c. cradle guide means mounted on said turret and consisting of a main guide rail, an auxiliary guide rail laid in parallel with said main guide rail and an auxiliary guide frame disposed immediately above and in parallel with said auxiliary guide rail, d. a cradle slidably mounted on said main guide rail, e. a cradle arm extended outwardly from said cradle at a right angle to the longitudinal axis thereof and having its free end guided by said second guide rail and said auxiliary guide frame, f. an elevation shaft extended from said cradle in the direction opposite to said cradle arm but coaxially thereof, g. an elevation barrel rotatably fitted over said elevation shaft coaxially thereof, h. a gun barrel mounted intermediate at its ends on the outer end of said elevation barrel in such a way that the axis of said gun barrel may be perpendicular to that of said elevation barrel, i. a hydraulic cylinder having its cylinder head mounted on said main guide rail and its piston rod pivoted to said cradle so that upon actuation of said hydraulic cylinder said cradle may be reciprocated along said main guide rail, and j. a linkage interconnecting between said turret and said elevation barrel in such a way that when said cradle is moved toward said shell of said furnace said elevation barrel may be rotated and consequently said gun barrel may be rotated in a vertical plane perpendicular to and including the axis of a tap hole of said furnace and pressed against said tap hole.

* * * * *

UNITED STATES PATENT AND TRADEMARK OFFICE

CERTIFICATE OF CORRECTION

PATENT NO. : 4,033,565

DATED : July 5, 1977

INVENTOR(S) : Masayuki Ueno and Fumiaki Sano

It is certified that error appears in the above-identified patent and that said Letters Patent are hereby corrected as shown below:

Column 1, line 17, change "filed" to --filled--;

Column 4, line 65, change "about" to --abut--;

Column 5, line 6, change "FIGS," to --FIGS.--;

Column 6, line 24, change "The" to --As the--; and

Column 8, line 42, change "proved" to --pivoted--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*